US005837187A

United States Patent [19]

Doersing et al.

[11] Patent Number: 5,837,187

[45] Date of Patent: Nov. 17, 1998

[54] HEAT TREATMENT APPARATUS FOR SOLUTION ANNEALING ALUMINUM ALLOY COMPONENTS

[75] Inventors: Hans Doersing, Delmenhorst; Dietmar Mietrach, Bookholzberg, both of Germany

[73] Assignee: Daimler-Benz Aerospace Airbus GmbH, Hamburg, Germany

[21] Appl. No.: 780,513

[22] Filed: Jan. 8, 1997

[30] Foreign Application Priority Data

Jan. 9, 1996 [DE] Germany ..... 196 00 479.9

[51] Int. Cl.[6] ..... C21D 11/00

[52] U.S. Cl. ..... 266/78; 266/99; 266/131; 266/133

[58] Field of Search ..... 266/130, 131, 266/132, 133, 100, 99, 78

[56] References Cited

U.S. PATENT DOCUMENTS

| | | | |
|---|---|---|---|
| 1,234,257 | 4/1917 | Bailey et al. | 266/130 |
| 2,063,784 | 12/1936 | Bechtel et al. | 266/132 |
| 3,378,412 | 4/1968 | Mansfield et al. | 266/131 |
| 3,744,776 | 7/1973 | Nyberg | 266/130 |
| 3,888,471 | 6/1975 | Coch | 266/130 |

FOREIGN PATENT DOCUMENTS

| | | |
|---|---|---|
| 0684318 | 11/1995 | European Pat. Off. . |
| 1508399 | 10/1969 | Germany . |
| 4035155 | 9/1991 | Germany . |

OTHER PUBLICATIONS

K.H. Illgner, Ofenanlagen für die Wärmebehandlung von Massenkleinteilen, Draht 3912 (1988) 3, pp. 417–421.

W. Hufnagel, Aluminium–Traschenbuch, 14. Auflage, Dec. 1983 pp. 431, 432, 492—501.

*Primary Examiner*—Scott Kastler
*Attorney, Agent, or Firm*—W. F. Fasse; W. G. Fasse

[57] ABSTRACT

An apparatus for the heat treatment of aluminum and aluminum alloy components in the aircraft manufacturing industry is precisely controlled in accordance with manufacturing regulations that must be satisfied if the components are to meet regulation quality standards for use in manufacturing an aircraft. For this purpose, the apparatus has a compact arrangement of four stations cooperating with a transport system that moves the components to be treated sequentially through the stations including an annealing station, a quenching station, a cleaning station, and a drying station arranged in that order in the transport direction. The transport system and the stations are controlled by a central processing unit for providing the required control signals, including closed loop controls and monitoring of all parameters that are necessary for a fault-free precisely repeatable heat treatment of the aluminum and aluminum alloy components.

17 Claims, 4 Drawing Sheets

HEAT TREATMENT APPARATUS FOR SOLUTION ANNEALING ALUMINUM ALLOY COMPONENTS

FIELD OF THE INVENTION

The invention relates to a heat treatment apparatus for solution annealing aluminum alloy components in the aircraft manufacturing industry. The apparatus is especially equipped for heat treating aluminum components in accordance with manufacturing regulations that must particularly be met by the aircraft industry when these aircraft components undergo a heat treatment, a quenching operation, a cleaning operation, and a drying operation.

BACKGROUND INFORMATION

Aluminum alloy components in the aircraft manufacturing industry such as plates or sheets or formed or deformed structural components having given minimal and maximal dimensions are subjected to heat treatments for improving the characteristics of these components.

It is known from metal working by machining and/or deforming that the metals undergo a work hardening transformation which increases the component strength. It is known to perform either prior to or after a deforming operation, a so-called soft or full annealing for the purpose of solving the stressed and deformed metal crystal structures to thereby form new crystals. The new crystals then provide the metal components with a "soft" characteristic corresponding to the crystal structure of the metal component prior to its deformation so that the metals can be further deformed in a further working sequence. This "soft" condition makes it possible to effectively and efficiently deform metals in general and aluminum and its alloys in particular.

It is further known that certain aluminum alloys can be improved in their material strength by special heat treatment methods such as a solution annealing following a deformation operation. For this purpose the aluminum alloys are, for example annealed at a temperature within a range of about 500° C. to 520° C. in a salt bath or in an air recirculating furnace. The immersion into the salt bath or the insertion into the air recirculating furnace requires that the structural components are manually secured, e.g. by tying, to support racks or that they are inserted into baskets. After completion of the annealing an instantaneous quenching of the component is performed either in water having a temperature that is always maintained below 20° C. or where thin components are involved, these thin components are exposed to a quenching airstream. Thereafter, an artificial aging process can be performed on certain alloys by storing the components in an oil bath or in an electrically heated air recirculating oven maintaining a temperature of about 100° C. to 200° C., whereby the residence time or cooling time ranges from about ½ hour to 24 hours. If the annealing took place in a salt bath, the components must be carefully cleaned to remove the salt remainders that may still stick to the component surfaces. This is necessary because the salts attack the metals.

European Patent Publication EP 0,684,318 A1 (Melber et al.), published on Nov. 29, 1995, discloses a method and apparatus for quenching of work pieces in an aqueous polymer solution. In order to prevent the entry of corrosive water vapor into an annealing oven or even into its prechamber, the quenching container is emptied into a storage tank during a time period when the quenching phase does not take place. The quenching phase itself takes place particularly for hardening of steels and steel alloys by an aqueous quenching liquid particularly an aqueous solution of polymers selected from the group of polyalkyleneglycols (PAG), modified polyalkyleneglycols, polyacrylates (ACR), polyvinyl pyrroledones (PVP), whereby the structural components are immersed into a quenching container. The structural components are either lowered into the quenching container prior to its refilling or flooding by the quenching liquid. In an alternative procedure the quenching container is filled with the quenching liquid prior to lowering the work pieces into the quenching container. The apparatus for performing the just described procedure combines the annealing oven with a quenching container which is arranged for cooperation with a storage tank and a conveying pump is arranged between the quenching container and the storage tank to empty and fill the container.

German Patent Publication DE 4,035,155 C1 (Kohnle), published on Sep. 12, 1991 discloses an apparatus for tempering of small parts of metal. The apparatus includes a quencher for the small parts that are coming out of a heat treatment oven. The apparatus also includes a container (11) for holding a warm salt bath and a drop chute (4) for transferring the small parts out of the oven (1) into the container (11). A parts catching mechanism is arranged in the container (11). A recirculation system (32) for the warm salt bath is connected to the container and a lifting mechanism is arranged for taking the small components out of the quenching container (11) which is followed by an after treatment device (42, 43, 44) into which the lifting mechanism (18, 14) transfers the small parts. The parts catching mechanism includes a revolving or rotatable device including at least three baskets (20) which are moved sequentially by a rotating drive (9) so that the filling opening of the baskets comes to be positioned under the drop chute (4). The recirculation device (32) is arranged in such a way for cooperation with the drop chute (4) that the circulated liquid salt flows from top to bottom through the basket that is currently in a registering position with the drop chute (4), whereby the liquid flows primarily downwardly through the basket. The lifting mechanism is arranged outside the drop chute (4) and it is constructed to hold a basket (20).

German Patent Publication 1,508,399 (Gutin), published on Oct. 30, 1969 discloses an apparatus for hardening of steel rings, especially rings for bearings. The rings are heated in a feed through oven or furnace. A transfer mechanism is arranged above a container holding quenching liquid, whereby rollers rotate the heated rings to be quenched. The Gutin apparatus further cooperates with alignment rollers for the rings and with a lifting table that feeds the rings to the rollers. For this purpose, the feed through furnace is provided at its bottom at least near its exit with a roller conveyor for the simultaneous discharge of all rings collected in a row extending in the direction of the furnace bottom width. The straightening or alignment rollers (40) are also arranged at the exit of the furnace and are constructed to apply to the rings forces that are independent of each other.

A publication "Aluminum Pocketbook" (Aluminium Taschenbuch), published by Aluminium-Zentrale, D üsseldorf, Federal Republic of Germany, Editor W. Hufnagel, published in 1983, pages 431, 432, and 492 TO 501 describes generally thermal treatments of aluminum and alloys thereof including solution annealing, quenching, and reannealing. Annealing temperatures for various aluminum alloys and general information regarding timing and aging procedures are provided. Water soluble polymers may be added to the water to provide different types of quenchants.

An article entitled "Offenanlagen fuer die Waermebehandlung von Massenkleinteilen" by K. H. Illgner, published in "Draht", Vol. 39, No. 3, 1988, pages 417 to 421, describes various annealing furnaces including feed through furnaces for heat simultaneously treating large numbers of small parts. Such furnaces must assure that each individual component out of a large number of components is provided with reproducible characteristics which must be maintained within narrow given tolerance limits. This uniformity applies to the strength characteristics and to the toughness characteristics at all locations within each part and to its surface characteristics. Various types of ovens or furnaces are described, including feed through ovens with cast plate conveyor belts.

The above discussed publications leave room for improvement, especially with regard to the transfer of components from the annealing furnace into the quenching baths and with regard to the compactness of the whole system.

OBJECTS OF THE INVENTION

In view of the above it is the aim of the invention to achieve the following objects singly or in combination:

- to provide a heat treatment apparatus of the type described in which solution annealing of aluminum and aluminum alloy components can be performed without faults while adhering to given manufacturing regulations that prescribe stringent manufacturing conditions which must be met consistently and which must be precisely repeatable;
- to minimize the processing times required in the various stations of the apparatus while automatically maintaining the process conditions in a reliably repeatable manner while causing minimal or no delays in the various steps of the heat treatment, quenching, cleaning and drying;
- to construct the entire treatment apparatus in such a way that it can be easily coordinated with and physically arranged close to a press for further deforming the treated structural components to thereby provide a compact system;
- to arrange the heat treatment apparatus and the deforming press in such a way that both can be operated by the same operator; and
- to minimize the quenching time while optimally reducing the treatment time altogether in a compact system.

SUMMARY OF THE INVENTION

The present system is characterized by the combination of the following features. A conveyor system for the structural components is provided with one or several conveyor belts and/or transport rollers on which the structural components are transported without any physical connection between the components and/or rollers and without any basket. A feed through furnace is positioned downstream of an infeeding transport belt and/or roller set for feeding the components into the furnace through which the components are transported on a transport belt and/or rollers. The furnace is provided with one or more heaters for heating the structural components depending on the particular alloy of which the components are made, to a solution annealing temperature of about 470° C. to about 570° C. while maintaining a given heating residence time within the furnace of about 10 to about 25 minutes. A quenching station having a quenching basin for a liquid quenchant is arranged downstream of the feed through furnace for quenching the structural components. The transport system includes a transfer section that forms a transition link between the output of the furnace and the quenching station. The transfer section is so arranged that the components move at an angle downwardly into the quenchant without forming any bubbles in the quenchant. Downstream of the quenching station there is arranged a cleaning station and a drying station through which the components are transported by a conveying belt. A central processing unit (CPU) provides a control system for controlling the operation of the entire apparatus including the transport system and the treatment stations. The CPU monitors and controls all parameters that are necessary for a fault-free heat treatment of the structural components and a proper sequence of the treatment steps for maintaining stringent tolerance limits in the treatment of such aluminum alloy components.

It is a special advantage of the invention that the annealing station which preferably comprises a feed through furnace or oven is substantially integrated with the quenching, cleaning, and drying stations and the resulting compact apparatus can be arranged close to a press for the further deforming of the treated structural components. This compact arrangement makes it possible to provide the heat treatment in accordance with strict regulations as required while minimizing the technical effort and expense and while permitting the operation of the heat treatment system and of the further deforming press by the same personnel.

Another advantage of the invention is seen in that the quenching of the heated components takes place with hardly any delays. The time duration between the time when any portion of an annealed component has a temperature falling below the solution annealing temperature to the time when the component is fully immersed in the quenching bath, is referred to as the quenching delay duration. The maximally permissible quenching delay duration of seven seconds, for example, may never be exceeded. The present system is preferably so constructed that this maximally permissible quenching delay duration is clearly reduced, whereby a quality improvement is achieved. Another very important advantage of the invention is seen in that a manual securing or attachment of the structural components, for example, by tying to the transport system prior to the heat treatment and the untying subsequent to the quenching are avoided. Similarly, the use of baskets is avoided.

BRIEF DESCRIPTION OF THE DRAWINGS

In order that the invention may be clearly understood, it will now be described, by way of example, with reference to the accompanying drawings, wherein.

DETAILED DESCRIPTION OF A PREFERRED EXAMPLE EMBODIMENT AND OF THE BEST MODE OF THE INVENTION

Figure 1:
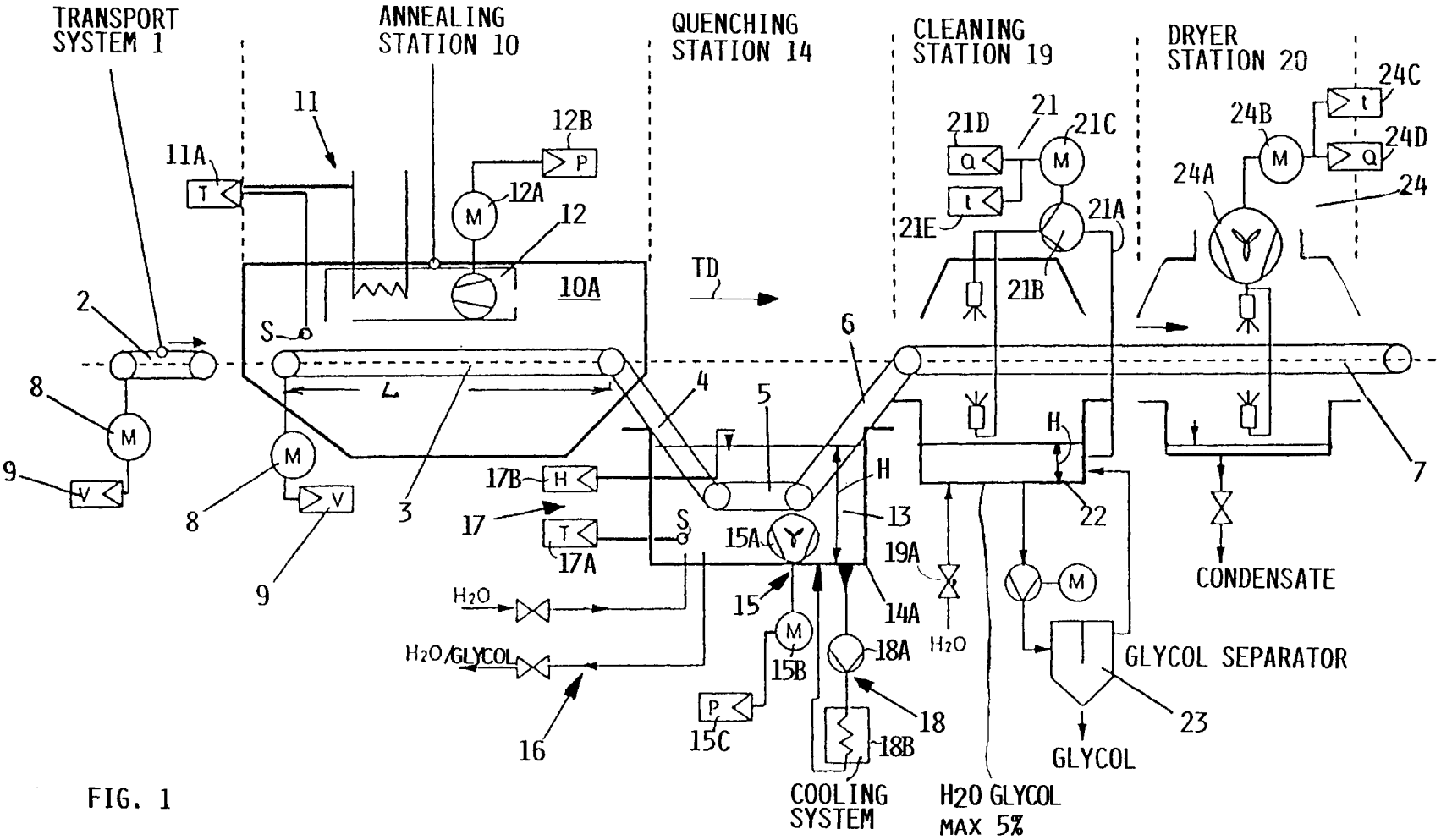
FIG. 1 is a diagram illustrating the station sequence of the present apparatus including the transport system for moving the components to be treated through the sequentially arranged stations.

FIG. 1 shows a transport system 1 including a plurality of conveyor sections 2, 3, 4, 5, 6, and 7 for transporting small parts through a plurality of treatment stations arranged in sequence. These stations include an annealing station 10 followed by a quenching station 14 followed by a cleaning station 19 followed by a dryer station 20. The feed advance or transport direction TD is shown by arrows from left to right in FIG. 1. The feed advance speed of the conveyors which may be belt conveyors or roller conveyors or any other suitable conveyors, is controlled by a central processing unit CPU shown in FIG. 3 to be described in more detail below. The central processing unit CPU also controls the residence times in the various stations and the synchronous or coordinate operation of all transport sections and all stations. The main parameters taken into account for the just mentioned control are illustrated in FIG. 4.

The transport system 1 is driven by electric motors 8 which are controlled by motor controls 9 in closed loop fashion. The motor controls 9 are in turn controlled from the central processing unit CPU. A first transport section 2 that comprises, for example a conveyor belt, feeds the parts to be treated into the inlet end of the annealing station 10 which is equipped with a second conveyor section 3 running along an electric heater 11 controlled by a heater control 11A in response to a temperature sensor S. The heater 11 is preferably an electrical resistance heater for heating the structural components resting on the transport belt 3 without actually being connected thereto. The heater or several heaters are dimensioned to assure a solution annealing temperature within the range of about 470°C. to about 570° C., depending on the type of alloy of which the components are made. This alloy information will be provided by the CPU. Simultaneously, the conveyor 3, or rather its motor 8 is controlled so that a residence time that is determined and given by the particular alloy to be treated, is assured in the furnace 10A. This residence time is normally within the range of about 10 minutes to about 25 minutes.

The annealing furnace 10A has an effective width of 2500 mm and an effective clearance of at least 160 mm. The effective length L of the furnace 10A will depend on the required throughput of components, on the duration for which the temperature must be held, and on the conveyor system or section passing through the furnace 10A. The furnace length L will also depend on the operating temperature which is within the range of $T_{MIN}$ of about 300° C. to a maximum temperature $T_{MAX}$ of about 600° C. controllable by the CPU. Although in FIG. 1 only one temperature control 11A and one sensor S are shown, the furnace 10A may have a plurality of such temperature sensors and temperature controls to provide the furnace with individually controllable heat control zones, the temperature of which is controlled in closed loop fashion to assure such a temperature distribution within the furnace 10A that the respective heat treatment regulations for the particular type of aluminum alloy are satisfied to make sure that after the treatment, these components or parts meet the required quality grade. Further, the furnace 10A may be equipped with entrance and exit doors or other closure mechanism for reducing or avoiding heat losses. These doors, curtains, or the like are also controlled by the CPU in accordance with the operational sequence of the apparatus. The furnace further comprises a blower 12 driven by a motor 12A controlled by a control 12B which in turn is controlled by the CPU to assure that the blower 12 operates with the required capacity or power P to assure the required hot air circulation in the furnace 10A.

Downstream of the annealing station 10 as viewed in the transport direction TD, the quenching station 14 is so arranged that its basin 14A holding quenchant 13 is positioned at a lower level than the exit of the furnace 10A. According to the invention a slanted transfer section 4 leads into the quenchant 13 in the basin 14A at such an angle that the components will enter the bath without splashing and without bubble formation as will be described in more detail below with reference to FIG. 2. The quenchant 13 is water or a water glycol solution in which the glycol proportion is within the range of 25 to 30% by volume of the quenchant volume. However, any other suitable quenchant may be used in the basin 14A. Preferably, the basin 14A is equipped with a quenchant circulating system 15 including a pump 15A driven by a motor 15B controlled by a motor control 15C which in turn is under the control of the CPU to assure the required circulation capacity or power. The basin 14A is also connected to a filling and emptying system 16 including valves for charging and discharging the basin 14A with the quenchant. A temperature control system 17 comprises a temperature sensor 17A in the quenchant 13 and a quenchant level sensor 17B to ascertain the level H of quenchant 13 in the basin 14A. Further, a cooling system 18 including a motor driven pump 18A and a heater exchanger 18B are also connected to the basin 14A for maintaining the required quenchant temperature. All the apparatus elements are controlled by the CPU in accordance with the parameters shown in FIG. 4.

Referring further to FIG. 1, the slanted transport section 4 according to the invention transfers the components to be treated from the furnace 10A into the quenchant 13 and cooperates with a third transport section 5 inside the basin 14A which in turn transfers the components to a section 6 bringing the components out of the bath 13 and onto a fifth transport section 7 section the components through the cleaning station 19 and the dryer station 20. Conveyor section 6 is a transport system comprising a transfer belt 6 which is 2500 mm wide with or without small steps for automatically carrying the components out of the basin 14A. The transfer belt 6 prevents components from falling back into the quenchant. The transport section 7 discharges the treated components to a discharge station not shown. The cleaning system 19 comprises a water sprayer 21 and a coolant collecting tank 22 connected through a pipeline 21A to pump 21B driven by a motor 21C responsive to a volume control 21D an a temperature control 21E. These controls 21D and 21E are also under the overall control of the CPU. The cleaning station 19 further comprises a glycol separator 23 connected to the tank 22 and including a motor driven pump. A water supply 19A is also connected to the tank 22. The control of the motor 21C and the water supply is such, that a required volume flow of the sprayed cleaning liquid water glycol mixture having a glycol content of maximally 5% by volume is maintained. The volume flow control and the control of the duration of the spraying times are such that the just mentioned maximum glycol content is maintained for the spraying liquid. However, it is also possible to use water as a cleaning liquid without any admixture of glycol.

The cleaned components are then passed through the dryer station in which a blower system 24 includes a blower 24A driven by a motor 24B controlled by a temperature responsive signal and by a volume flow responsive signal provided by respective sensors 24C and 24D also controlled by the CPU.

Figure 2:
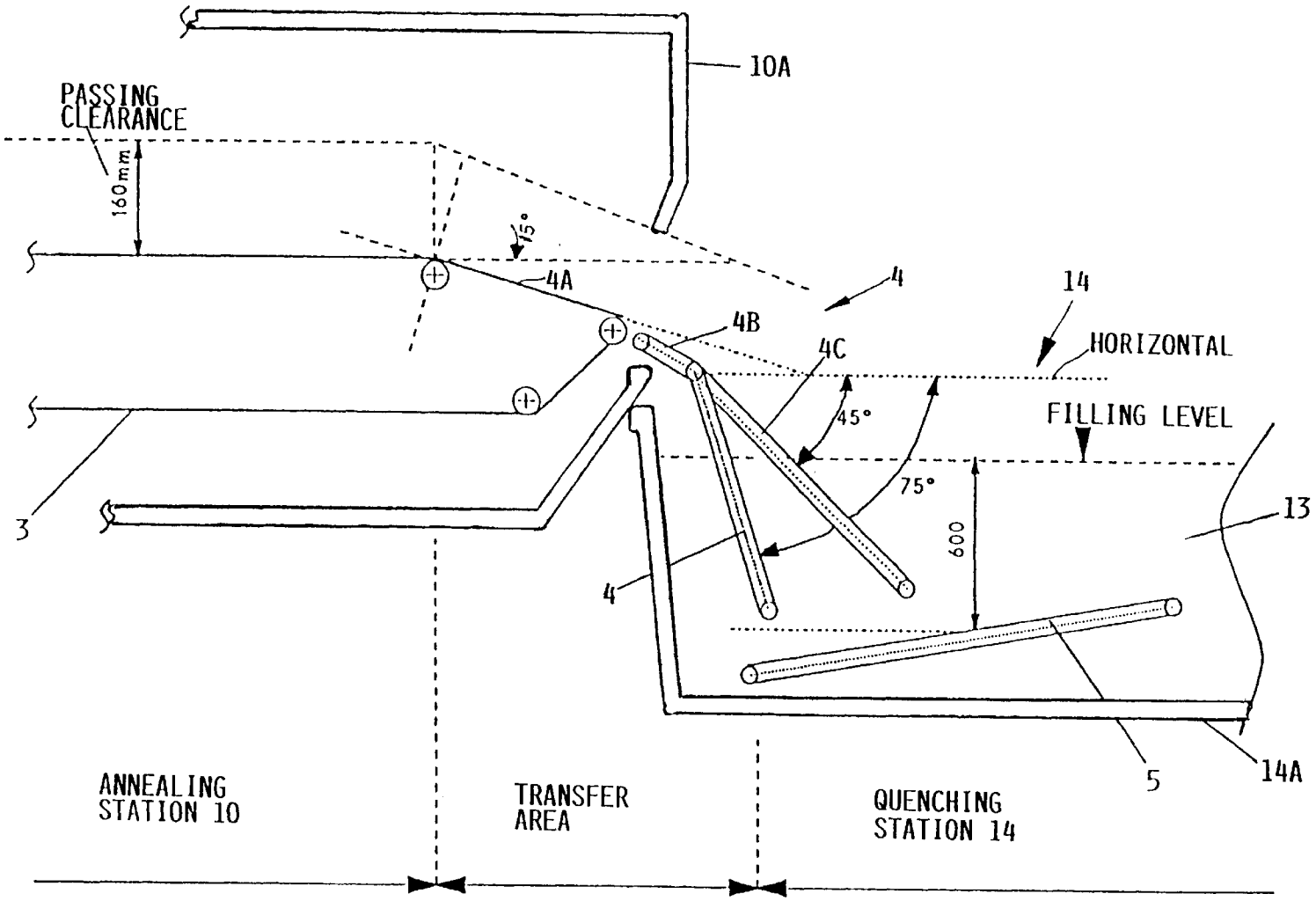
FIG. 2 illustrates on a scale enlarged relative to FIG. 1, the transition area between the annealing station and the quenching station.

FIG. 2 shows the transfer section 4 of the transport system 1 in more detail. This transfer section 4 is positioned in the exit area of the furnace 10A to bridge a transit area and to lead into the quenchant 13 in the basin 14A at a predetermined angle. For this purpose the transfer section 4 comprises several portions 4A, 4B, 4C. The arrangement is such and the slanting angle so selected, that the components will enter into the bath or quenchant 13 without the formation of bubbles. The upstream first portion 4A may be part of the end of the transport section 3 and this portion 4A is arranged relative to the horizontal at an angle of about 15°. The end section 4C is arranged at an angle to the horizontal within the range of about 45° to about 75°. This angle is adjustable by mechanical devices. A transition portion 4B covers the gap between the downstream end of the portion 4A and the upstream end of the portion 4C. Portion 4B may be fixed at an angle to the horizontal larger than 15°. Portion 4C is preferably hinged to the lower end of portion 4B for the angle adjustment.

Figure 3:
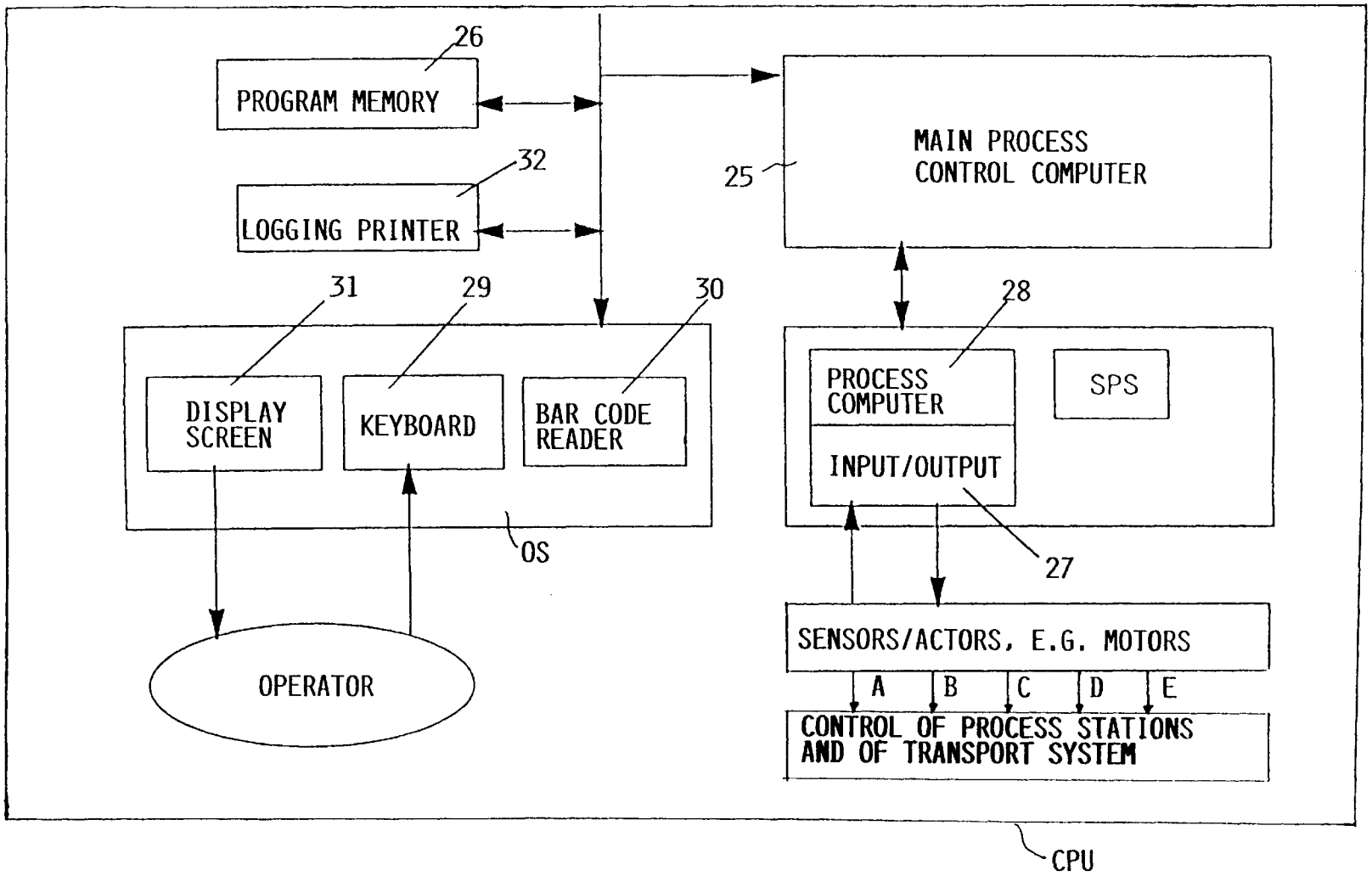
FIG. 3 illustrates a block diagram of the central processing unit used for operating the present heat treatment apparatus.
Figure 4:
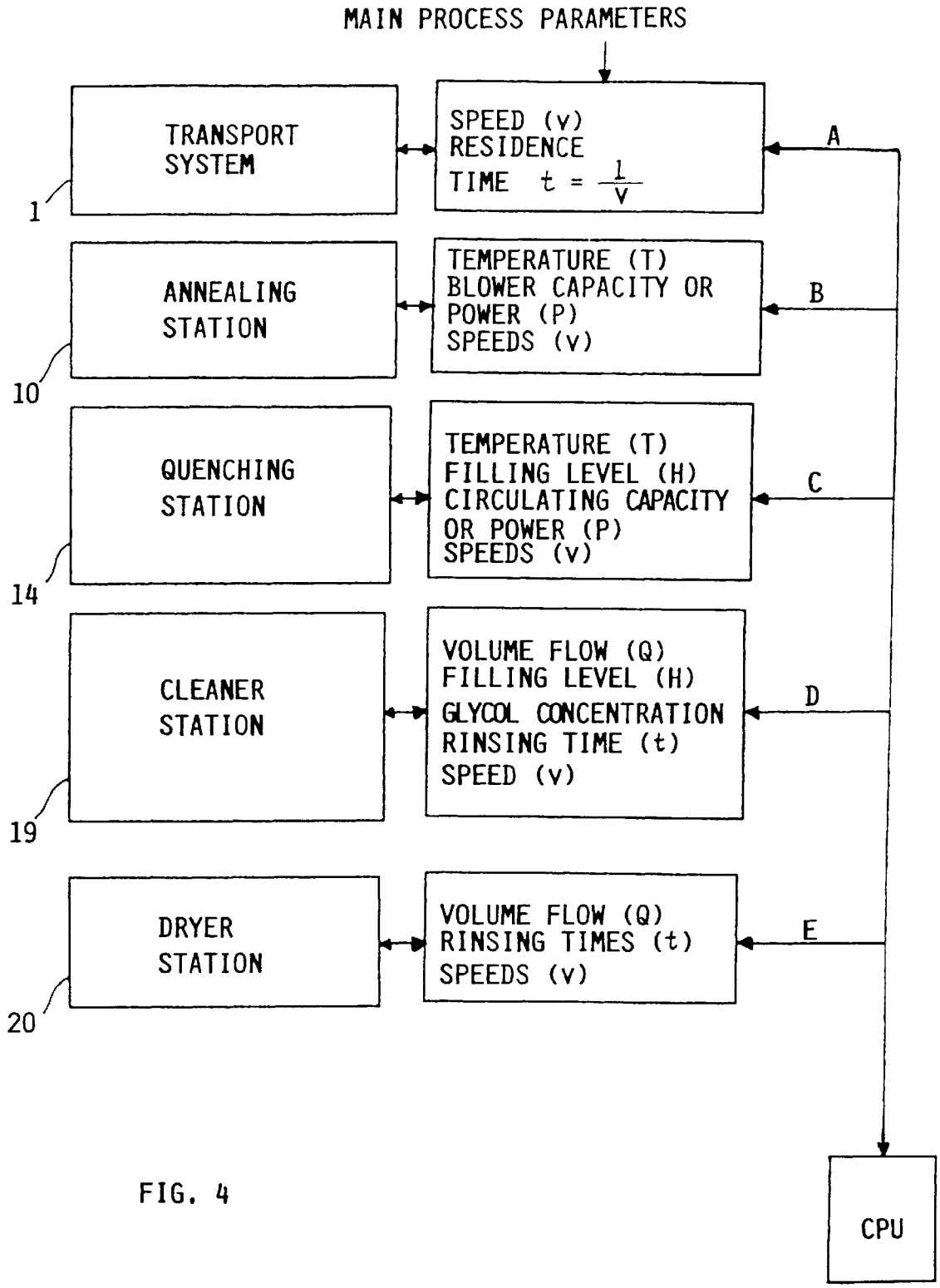
FIG. 4 is a block diagram illustrating the main process parameters that are employed by the central processing unit of FIG. 3 for operating the present apparatus.

FIG. 3 shows in block form the components of the process control system forming the CPU to provide for a fully automatic operation of the treatment apparatus according to the invention. The CPU provides, in addition to the above outlined controls, visual information of the current process status and a printout. The closed loop controls for the motors 8 described above are supervised by the CPU. Monitoring and diagnosing of any process errors are also performed by the CPU. For this purpose the CPU comprises a main process computer 25 connected to a program memory 26 having, for example, twenty memory locations for the heat treatment process parameters. An input/output unit 27 is connected through a process computer 28 to the main process control computer 25. An operator station OS is connected to the main process control computer, to the program memory 26, and to a logging printer 32 that provides documentation for the operations performed for any particular batch of parts. The operator station OS includes a keyboard 29, a bar code reader 30, and a display screen 31.

FIG. 4 illustrates the various main parameters as provided either from the sensors of the system or from entries by the operator. These main parameters may be supplemented by other parameters not shown.

Although the invention has been described with reference to specific example embodiments, it will be appreciated that it is intended to cover all modifications and equivalents within the scope of the appended claims.

What is claimed is:

1. An apparatus for treating, including solution annealing components made of aluminum alloys, comprising a plurality of sequentially arranged treatment stations and a transport system (1) including movable elements for holding and moving said components in a transport direction (TD) sequentially through said treatment stations without securing said components to said movable elements of said transport system, said treatment stations comprising:

(a) an annealing station (10) including a feed through furnace (10A) including a heater (11) for maintaining in said feed through furnace a temperature controllable within the range of 470° C. to 570° C., (b) a quenching station (14) arranged downstream of said annealing station including a quenching basin (14A) arranged downstream of said furnace (10) as viewed in said transport direction (TD) for holding a liquid quenchant (13), (c) a cleaner station (19) arranged downstream of said quenching station (14) for cleaning quenched components, (d) a dryer station (20) arranged downstream of said cleaner station (19) for drying cleaned components, and wherein said transport system comprises a transfer section (4) positioned at an exit of said feed through furnace at an angle to the horizontal for transporting said components out of said feed through furnace (10A) into said quenching basin (14A) of said quenching station (14), said angle being so selected that said components enter said liquid quenchant (13) free of bubbles, said apparatus further comprising a central processing unit (CPU) including a computerized control system operatively connected to said treatment stations and to said transport system (1) for controlling the operation of said treatment stations and transport system so that said components have a controlled residence time in said feed through furnace and so that the operations of all treatment stations are coordinated to each other.

2. The apparatus of claim 1, wherein said transport system (1) comprises:

(a) a first section (2) positioned upstream of said furnace (10A) for transporting said components into said furnace (10A) in said transport direction (TD), (b) a second section (3) positioned in said furnace (10A) for transporting said components through said furnace (10A) and including a drive (8) controllable (9) for maintaining said components in said furnace for said controlled residence time of about 10 to 25 minutes, (c) a third section (5) positioned in said quencher basin (14A) of said quenching station (14) for transporting said components through said quenching station (14), (d) a fourth section (6) positioned for transporting quenched components out of said quenching station (14), and (e) a fifth section (7) positioned for transporting quenched components through said cleaner station (19) and through said dryer station (20), and wherein said transfer section (4) of said transport system forms a transition link between said second section (3) and said third section (5) of said transport system.

3. The apparatus of claim 1, wherein said transport system comprises roller driven transport belts, and wherein speeds of said transport belts (2 to 7) are coordinated or synchronized by said central processing unit (CPU) with given treatment sequences.

4. The apparatus of claim 1, wherein said transport system comprises a transport belt (3) passing through said furnace (10A), said transport belt (3) having an end portion (4A) extending at an angle of about 15° relative to the horizontal, and wherein said transfer section (4) of the transport system comprises, in a transition area between said furnace (10A) and the quenching station (14), a slanted portion (4B, 4C) having an angle that is adjustable within the range of 45° to 75° relative to the horizontal for avoiding the formation of bubbles as said components enter said quenchant (13).

5. The apparatus of claim 2, wherein said slanted portion (4B, 4C) of said transfer section (4) of said transport system in said transition area comprises a transport belt that is roller driven and forms a sliding chute.

6. The apparatus of claim 1, wherein said annealing furnace (10A) comprises an electrical resistance heater (11) controlled by said CPU for providing an indirect heating of said furnace (10A).

7. The apparatus of claim 6, wherein said electrical resistance heater (11) is controlled in closed loop fashion by said central processing unit (CPU) to maintain an operational temperature in the annealing furnace within the range of $T_{MIN}$ of about 300° C. to $T_{MAX}$ of about 600° C.

8. The apparatus of claim 1, wherein said furnace (10A) comprises a plurality of heat control zones (12) with sensors (S) for providing a temperature characteristic in said furnace (10A) that will satisfy the quality grade required to be met by said components following heat treatment.

9. The apparatus of claim 1, wherein said furnace (10A) comprises inlet and outlet closures for reducing or avoiding heat losses, and wherein said closures are controlled in a closed loop manner by said central processing unit (CPU) in accordance with the entrance and exit of components into and out of said furnace (10A).

10. The apparatus of claim 8, wherein each of said heat control zones comprises its own heat sensor (S) or thermoelement, and wherein output signals of said heat sensors (S) are provided to said central processing unit (CPU) for evaluation and for controlling said electrical heater (11).

11. The apparatus of claim 1, further comprising a blower system in said feed through furnace (10A).

12. The apparatus of claim 1, wherein said quenching station (14) comprises a basin (14A) for holding a quenchant (13).

13. The apparatus of claim 1, wherein said quenching station (14) comprises a quenchant circulating system (15), a filling and discharging system (16), a temperature control unit (17), and a cooling system (18) all connected to a quenchant basin (14A) and controllable through said central processing unit (CPU).

14. The apparatus of claim 1, wherein said cleaning station (19) comprises a water spraying mechanism (21) for cleaning the components by a water spray, a collecting tank (22), a glycol separator (23) connected to said tank (22), and wherein the volume flow of cleaning liquid and the time durations for the application or spraying of cleaning liquid, as well as the glycol concentration in the collecting tank (22) is maintained at a given minimum value through the central processing unit.

15. The apparatus of claim 14, wherein said water spraying system (21) is connected through a pipeline (21A) to the collecting tank (22).

16. The apparatus of claim 1, wherein said dryer station comprises an air blower (24) driven by a motor controlled by said central processing unit (CPU) for controlling the air volume and the air temperature of the drying air.

17. The apparatus of claim 1, wherein said central processing unit (CPU) comprises a program memory (26) connected to a main process computer (25) including an input output unit (27), and a process computer (28) including an operator station (OS) including a keyboard a bar code reader, and a display screen.

* * * * *